United States Patent [19]

Baum

[11] 4,188,686

[45] Feb. 19, 1980

[54] APPARATUS FOR COLD SEALING THE GATHERED END OF A PLASTIC BAG

[76] Inventor: Günter Baum, Auhofstrasse 24, Zürich Ch 8051, Switzerland

[21] Appl. No.: 893,015

[22] Filed: Apr. 3, 1978

[30] Foreign Application Priority Data

Apr. 4, 1977 [CH] Switzerland ..... 4310/77

[51] Int. Cl.[2] ..... B65D 77/10; B65B 7/06

[52] U.S. Cl. ..... 24/30.5 L; 24/115 G; 24/135 L; 339/272 R; 53/371; 156/580; 24/263 A

[58] Field of Search ..... 24/115 G, 30.5 L, 136 B, 24/135 L; 81/1 N; 53/371; 339/272 R

[56] References Cited

U.S. PATENT DOCUMENTS

| | | | |
|---|---|---|---|
| 249,334 | 11/1881 | Gibbons | 24/135 L |
| 789,994 | 5/1905 | Myers | 24/115 G |
| 2,667,695 | 2/1954 | Price | 24/115 G |
| 4,001,075 | 1/1977 | Menzner | 156/581 |
| 4,079,570 | 3/1978 | Rucker | 156/581 |

FOREIGN PATENT DOCUMENTS

| | | | |
|---|---|---|---|
| 173725 | 1/1953 | Austria | 24/135 L |
| 878127 | 6/1953 | Fed. Rep. of Germany | 24/135 L |

*Primary Examiner*—Bernard A. Gelak
*Attorney, Agent, or Firm*—Wilson, Fraser, Barker & Clemens

[57] ABSTRACT

This invention relates to a clamping mechanism which is effective to produce a high compressive force on the gathered open end of a thermoplastic bag containing an appropriate product, such as food items for freezing, characterized by the fact that a high compressive force is supplied to at least two spaced portions of the gathered bag end material to effect the sealing of the bag material through cold flow of the material and without the application of any external heat.

5 Claims, 7 Drawing Figures

APPARATUS FOR COLD SEALING THE GATHERED END OF A PLASTIC BAG

BACKGROUND OF THE INVENTION

Thin-walled flexible bags are employed both in the home and industry for the packaging of a large variety of items. In the home, in particular, it is common practice to employ such bags, formed of a thermoplastic material such as polyethelyne or polyvinylchloride, for the packaging of food products which are subsequentially frozen. A more secure package is obviously obtained if a fusion seal of the open end of the thermoplastic bag could be obtained, but in the home, this is an impractical and inconvenient procedure to attempt. There is, therefore, a need for a mechanism which will effect a fusion seal of the gathered open end of a thin-walled flexible thermoplastic bag without the application of external heat.

In my Swiss Pat. application Ser. No. 4809, filed Apr. 13, 1976, I have disclosed one form of a clamping mechanism for applying substantial compressive forces to the gathered open end of a thermoplastic bag to effect the sealing thereof by cold flow of the thermoplastic material induced by the compressive forces. The clamping device disclosed in my aforementioned Swiss patent application had the disadvantage that the clamping force was applied through the advancement of a screw threaded clamping member into a threaded hole provided in the end of a mass of plastic material and at the bottom of such hole, a channel was provided for the insertion of the gathered open end of the thermoplastic bag. As mentioned in said Swiss patent application, this construction suffered from the disadvantage that only a limited amount of compressive force could be applied to the gathered bag end without the body of the clamp deforming outwardly under the effect of the compressive forces.

OBJECTS OF THE INVENTION

Accordingly, an object of this invention is to provide an improved clamping mechanism for effecting the cold sealing of the gathered open end of a thin-walled thermoplastic bag solely through cold flow induced in such material through the application of high compressive forces to a band like area of the gathered thermoplastic material.

A further object of the invention is to provide a cold sealing clamping mechanism for thermoplastic bags or the like which may be conveniently manually grasped and operated so that consistent, effective seals may be produced by the average housewife without the benefit of any extensive instruction or experimentation.

Other objects and advantages of the invention will become apparent from the following description taken in conjunction with the annexed sheets of drawings.

DESCRIPTION OF PREFERRED EMBODIMENT

Figure 1:
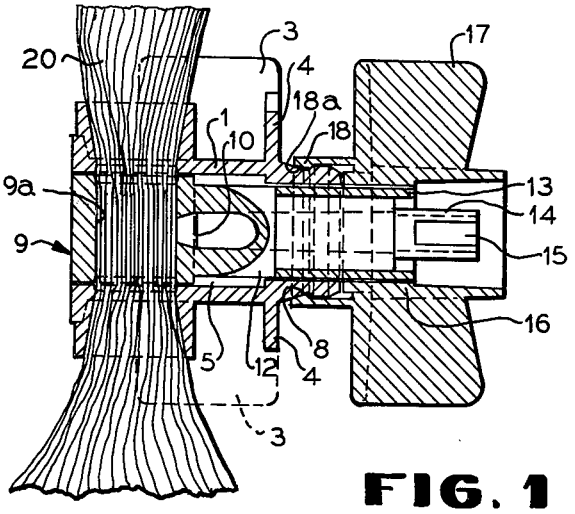
FIG. 1 is a vertical cross-sectional view of a bag end clamping and sealing device embodying this invention showing the gathered end of the bag inserted in the device.
Figure 2:
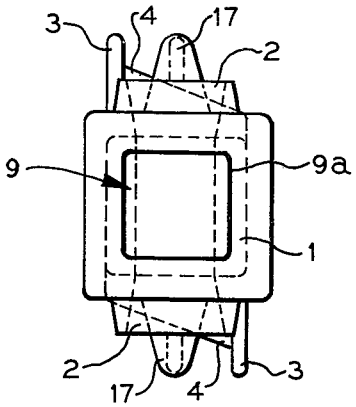
FIG. 2 is a left side elevational view of FIG. 1.

Referring to the drawings, the clamping and sealing device embodying this invention comprises a hollow body member provided with an elongated hollow core 1*a* which has one end portion 5 of rectangular cross-sectional configuration and the other end portion 6 of cylindrical configuration. A plunger 9 is provided which is axially slidable within the bore 1*a* of body member 1. Plunger 9 has a generally rectangular end portion 9*a* which slidably cooperates with the rectangular bore 5 and hence prevents any relative rotational movement of the plunger 9 relative to the body member 1. The remaining portion 12 of the plunger 9 is of cylindrical configuration and cooperates with the cylindrical bore 6 of the body member 1. The end of shaft 12 is provided with screw threads 13 and at the end of threaded portion 13 there is provided two hollow cylindrical segments 14 of smaller diameter than the threaded portion 13. The outer most ends of segments 14 are respectively connected to elastically deformable stop elements 15.

While both the body member 1 and the plunger 9 may be formed of any metal, the device will be completely operative and more economical to manufacture if these components are formed from a thermoplastic material.

Plunger 9 is axially shifted relative to the body member 1 by a manually operable nut member 16 having integral wings 17 to facilitate its manual rotation. Projecting from one end of nut member 16 is a cylindrical mounting flange 18 having an inwardly projecting rib 18*a* which snaps into engagement with an annular channel 8 provided on the extremity of the body member 1. The nut member 16 is thus secured to body member 1 insofar as axial movements are concerned, but is readily rotatable with respect to the body member 1 and the cooperation of nut member 16 with the threads 13 on the plunger 9, effects the axial displacement of said plunger.

Figure 6:
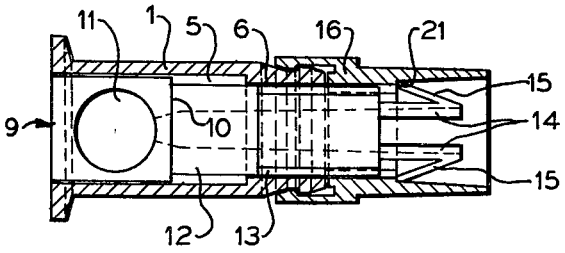
FIG. 6 is a sectional view taken on the plane 6—6 of FIG. 3.

Referring particularly to FIG. 1, plunger 9 is shown in its one extreme axial position relative to body member 1. In this position, further axial movement of the plunger 9 toward the left as viewed in FIGS. 1 and 6 is prevented by the engagement of the resilient projections 15 with an internal shoulder 21 provided in the wing nut 16.

In this position, an axially transverse passage 2*a* is provided in body member 1 and a similar passage 9*a* in plunger member 9, and these passages are aligned so as to permit the gathered open end of a thermoplastic bag 20 to be inserted within the aligned passages. Body member 1 may be provided with integral funnel-shaped guides 2 to facilitate the insertion of the gathered bag end 20 into the aligned passages 2*a* and 9*a*.

Figure 3:
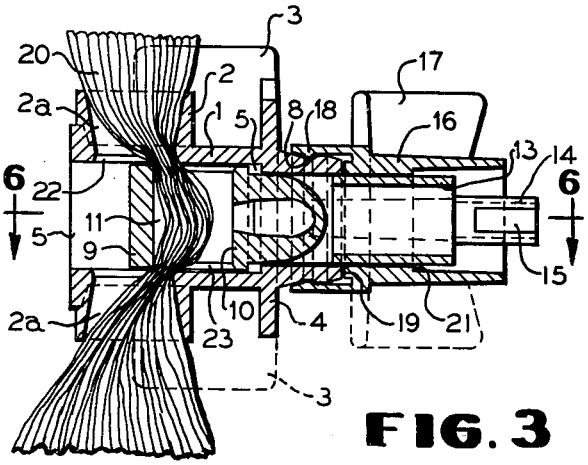
FIG. 3 is a view similar to FIG. 1 but showing the position of the elements of the device during the application of compressive forces to the gathered end of the inserted bag material.
Figure 4:
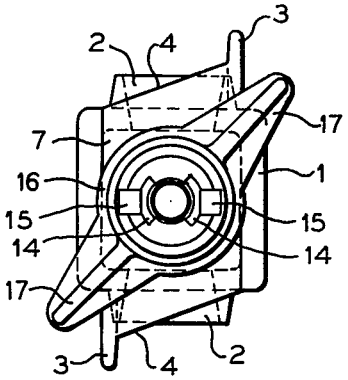
FIG. 4 is a right side elevational view of FIG. 3.
Figure 5:
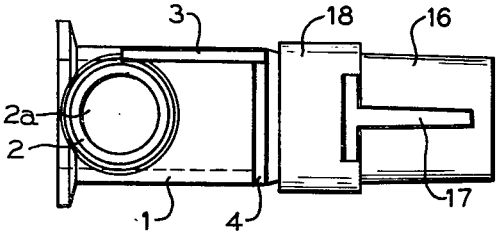
FIG. 5 is a top elevational view of the device of FIG. 1 with no bag end inserted therein.

Referring now to FIG. 3, it will be apparent that manual rotation of the nut 16 will effect an axial displacement of the plunger 9 and the portion of the bag member 20 that is inserted within the transverse passage 9*a*. To facilitate the relative rotation of nut member 16 with respect to body member 1, body member 1 may be provided with integral radially projecting flanges 3 so as to permit a firm grasp to be applied to body member 1.

Figure 7:
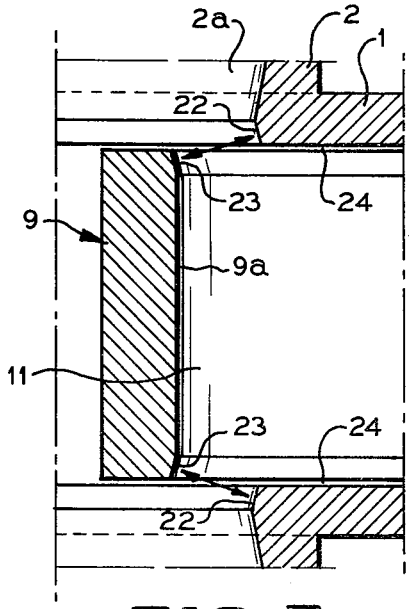
FIG. 7 is an enlarged scale, partial sectional view showing the cooperation of the walls of the bag end receiving apertures provided in the plunger and body member respectively of the device of FIG. 1.

The result of the axial displacement of the plunger 9 is to apply an ever increasing compressive force to two spaced regions of the inserted gathered bag material 20. The compressive forces are respectively applied adjacent the top and bottom portions of the transverse apertures 9*a* and the right hand upper and lower walls of the aperture 2*a* as viewed in FIG. 3. To prevent the possibility of tearing the thermoplastic material, those portions of the apertures 9*a* and 2*a* which are in direct contact with the inserted gathered bag material 20 are provided with tapered surfaces 23 and 22 (FIG. 7), respectively, so as to apply the compressive forces over a band of the gathered thermoplastic material.

Due to the provision of the grasping flanges 3 and the wings 17, a substantial torque can be manually applied to the nut 16, resulting in a large compressive force being exerted on the inserted bag material 20 at the two regions respectively defined by the upper and lower contacting surfaces 22–23. The compressive force is sufficiently large to exceed the flow limit of the bag material and sealing of the bag material is achieved by cold flow of the thermoplastic material, resulting in a very effective water proof and airtight seal without the application of any external heat.

Modifications of this invention will be obvious to those skilled in the art and it is intended that the scope of the invention be limited solely by the appended claims.

I claim:

1. A clamp for cold sealing the gathered open end of a bag formed of thin walled, flexible thermoplastic material comprising, in combination:

(1) a tubular body member having external flange means permitting it to be securely held by the hand of the user and a longitudinal bore extending therethrough; one end portion of said bore being non-circular; and the other end portion being defined by a cylindrical sleeve portion;

(2) a plunger slidably mounted in said bore for axial movements relative thereto, said plunger having a non-circular portion slidably cooperating with said non-circular portion of said bore to prevent relative rotational movement of said plunger and body member;

(3) screw threads on one axial end of said plunger;

(4) a nut member cooperable with said screw threads;

(5) means mounting said nut member on said sleeve portion of the body member for rotation about the axis of said longitudinal bore but axially fixed relative to said body member, whereby rotation of said nut member produces axial shifting of said plunger relative to said body member;

(6) said body member and said other end of said plunger each having a transverse passage therethrough, which passages are alignable in one axial position of said plunger relative to said body member and are proportioned to receive therein the gathered open end of a thin walled thermoplastic bag, whereby subsequent rotation of said nut produces a high compressive force on said gathered thermoplastic material between a wall of said transverse plunger passage and a wall of said transverse body member passage sufficient to seal the gathered thermoplastic by cold flow without the application of external heat.

2. The combination defined in claim 1 wherein said non-circular portion of said bore is of rectangular cross-section and said transverse passages extend through the rectangular cross-section portions of the body member and the plunger, thereby providing two spaced wall areas on the body member against which the gathered thermoplastic bag material is respectively compressed by two spaced wall areas on the plunger member.

3. The combination defined in claim 2 wherein all said wall areas are tapered at an angle to the longitudinal bore axis to prevent tearing of the thermoplastic material compressed therebetween.

4. The combination defined in claims 1, 2, or 3 plus external flange means on said nut facilitating the application of manually applied turning force thereto.

5. A clamp for cold sealing the gathered open end of a bag formed of thin-walled, flexible thermoplastic material comprising, in combination:

(1) a body member having an axially elongated bore extending therethrough, one end portion of said bore having a rectangular cross-section;

(2) a rectangular plunger slidably mounted in said bore for axial movements relative thereto;

(3) said body member and said plunger each having an axially transverse passage therethrough, which passages are alignable in one axial position of said plunger relative to said body member and are proportioned to receive therein the gathered open end of a thin-walled thermoplastic bag, whereby axial displacement of said plunger relative to said body member from said aligned position, produces a compressive force on said gathered thermoplastic material between a wall of said transverse plunger passage and a wall of said transverse body member passage;

(4) screw threads on one axial end of said plunger spaced from said transverse passage;

(5) a nut member cooperable with said screw threads;

(6) and means mounting said nut member on said body member for rotation about the axis of said bore but with said nut member being axially fixed relative to said body member, whereby rotation of said nut member produces axial shifting of said plunger relative to said body member to misalign said transverse passages and effect a high compressive force on the gathered thermoplastic material inserted in said transverse passages.

* * * * *